United States Patent [19]

Itkis

[11] Patent Number: 4,624,462

[45] **Date of Patent: * Nov. 25, 1986**

[54] ELECTRONIC CARD AND BOARD GAME

[76] Inventor: Yuri Itkis, 759-H Arcadia Ave., Arcadia, Calif. 91006

[ * ] Notice: The portion of the term of this patent subsequent to Jun. 19, 2001 has been disclaimed.

[21] Appl. No.: 611,951

[22] Filed: May 18, 1984

Related U.S. Application Data

[63] Continuation-in-part of Ser. No. 301,118, Aug. 11, 1981, Pat. No. 4,455,025.

[51] Int. Cl.[4] ..... A63F 3/06

[52] U.S. Cl. ..... 273/237; 273/269

[58] Field of Search ..... 273/237, 238, 239, 269, 273/286

[56] References Cited

U.S. PATENT DOCUMENTS 3,671,041 6/1972 Taylor et al. ..... 273/237

4,455,025 6/1984 Itkis ..... 273/237

*Primary Examiner*—Leo P. Picard

*Attorney, Agent, or Firm*—Roylance, Abrams, Berdo & Goodman

[57] ABSTRACT

An electronic card and board game for playing bingo, keno, and the like games, wherein the master game board being operated by the caller generates and transmits random bingo numbers and game patterns, and the player's game board receives and processes the bingo numbers and game patterns, and the player's game board receives and processes the received information in conjunction with locally originated data determining the contents of a multiple bingo card. The multiple bingo card is implemented as a replaceable, removable transparent template bearing imprinted bingo numbers. In working position, the card overlays a dot-matrix display incorporated in the player's game board. The display is controlled by a microprocessor. The microprocessor activates the display dots located beneath the bingo numbers matching those transmitted by the master board via a radio channel. The microprocessor computes bingo numbers on the card using the identification number of the card in accordance with a predefined algorithm.

7 Claims, 12 Drawing Figures

63

| | | | | | | | | | | | | | | | | | | | | | | | | |
|---|---|---|---|---|---|---|---|---|---|---|---|---|---|---|---|---|---|---|---|---|---|---|---|---|
| 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 |
| 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 |
| 76 | 77 | 78 | 79 | 80 | 81 | 82 | 83 | 84 | 85 | 86 | 87 | 88 | 89 | 90 | 91 | 92 | 93 | 94 | 95 | 96 | 97 | 98 | 99 | 100 |
| 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 |
| 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 |
| 76 | 77 | 78 | 79 | 80 | 81 | 82 | 83 | 84 | 85 | 86 | 87 | 88 | 89 | 90 | 91 | 92 | 93 | 94 | 95 | 96 | 97 | 98 | 99 | 100 |
| 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 |
| 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 |
| 76 | 77 | 78 | 79 | 80 | 81 | 82 | 83 | 84 | 85 | 86 | 87 | 88 | 89 | 90 | 91 | 92 | 93 | 94 | 95 | 96 | 97 | 98 | 99 | 100 |
| 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 |
| 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 |
| 76 | 77 | 78 | 79 | 80 | 81 | 82 | 83 | 84 | 85 | 86 | 87 | 88 | 89 | 90 | 91 | 92 | 93 | 94 | 95 | 96 | 97 | 98 | 99 | 100 |

Fig. 11

ELECTRONIC CARD AND BOARD GAME

REFERENCE TO RELATED APPLICATION

This application is a continuation in part of my copending application Ser. No. 301,118 filed Aug. 11, 1981 now Pat. No. 4,455,025, entitled "Electronic Card and Board Game", the entire disclosure of which is hereby incorporated by reference.

SUMMARY OF THE INVENTION

The present invention is an electronic card and board game for playing card and chance games, such as bingo, keno, and the like. The game is being played by at least two participants, namely, the game operator, such as the caller in the bingo game, and at least one individual player. In the process of the game, the game operator utilizes the master electronic game board, and the individual player utilizes the player's electronic game board. In the preferred embodiment, the design of the master board is identical to the design of the player's board, but a broad variety of different designs of the master game board and the player's game board can be implemented.

Both the master game board and the player's game board are controlled by embedded microprocessors and are equipped with keyboards and graphics displays. Upon the game operator's command entered via the keyboard, the master game board generates and radio broadcasts encoded discretionary and random data relevant to the game, such as bingo pattern and random bingo numbers. This data is received, decoded, and processed by the player's game board. Specifically, the received random data is compared with the numerical contents of at least one game card, such as a bingo card, residing in the memory of the microprocessor controlling the player's game board. Matches discovered as a result of this comparison are signalled to the player. The current pattern of matches is compared with the required game pattern transmitted by the master game board. The winning combination of matches is being signaled visually and audibly.

The game card being used by the player is implemented as a replaceable, removable, transparent template overlaying the display and bearing imprinted game symbols, such as bingo numbers. The microprocessor signals the discovered matches by activation, e.g. darkening, the areas of the display located immediately beneth the respective symbols on the card. As a result, a visual image of a marked game card is created.

The contents of the game card are computed by the microprocessor on the basis of the identification number of the game card in accordance with a predetermined algorithm. The default identification number is being prestored in the memory of the microprocessor, and, upon replacement of the game card, the player can update the identification number of the card by simple keyboard entries.

The primary objective of the invention is to provide an electronic card and board game which relieves the player from the tedious and error-prone operation of manual marking matches on the game card. In particular, it is the objective of the invention to provide a completely automated bingo game in which the player does not have even to touch or watch the game card or the game board at any time during successive rounds of the game, whereas the caller has only to push a single button to control the game. It is the further objective of the invention to provide a design of the game board which facilitates a broad and easy selection of the game cards and games being played with the help of the same game board. An additional objective of the invention is to preclude unauthorized or untimely change of the game card by the player.

Other objectives and features will become apparent from the following specification.

BRIEF DESCRIPTION OF THE DRAWINGS

FIG. 11 is the partial view of the multiple keno card template.

DESCRIPTION OF THE PREFERRED EMBODIMENT

Figure 1:
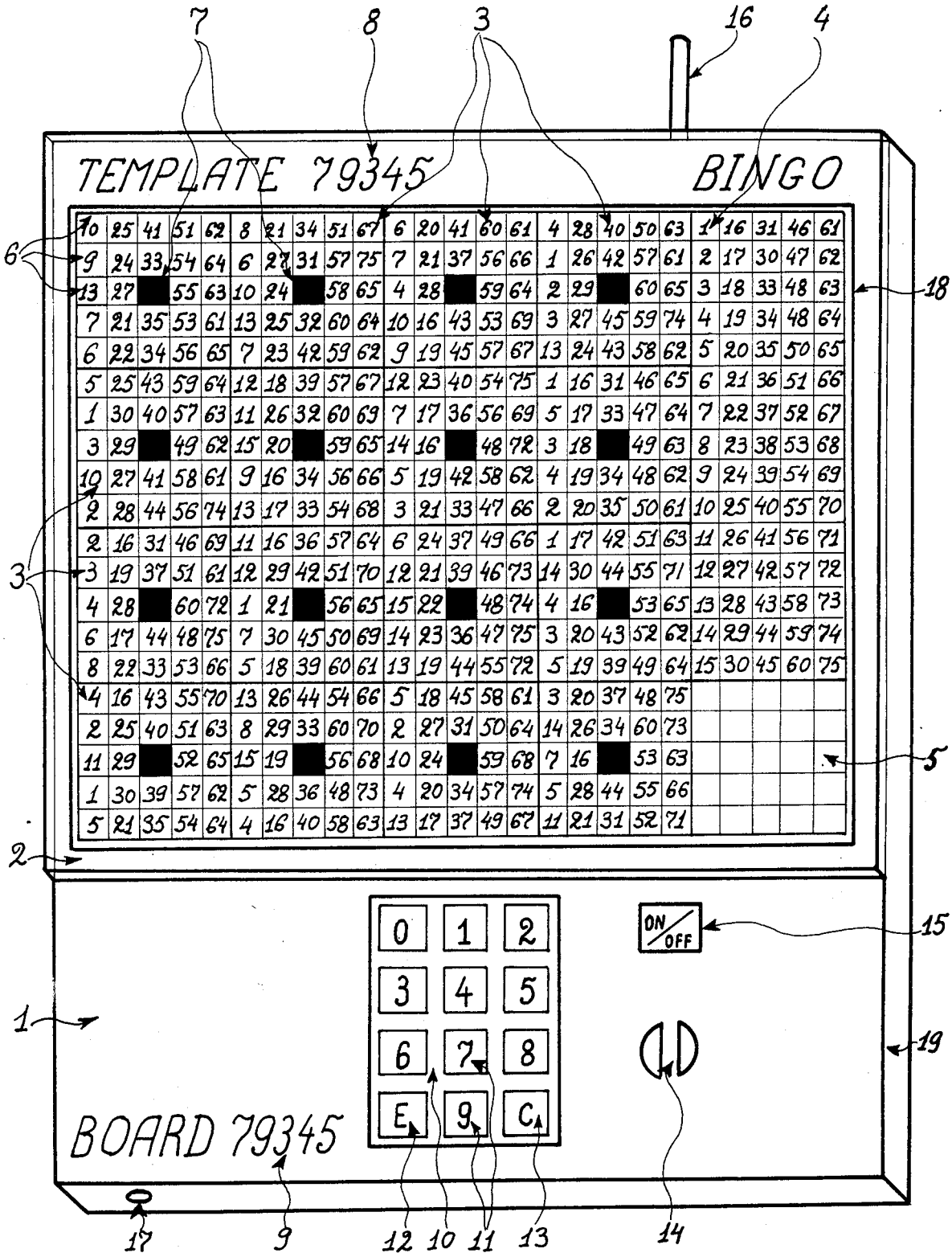
FIG. 1 is the perspective view of the game board and the multiple bingo card template.

The axonometric view of the preferred embodiment of the electronic card and board game is presented in FIG. 1, wherein 1 is the game board and 2 is the removable and replaceable transparent overlay template bearing imprinted images of sixteen individual five-by-five bingo cards 3, the five-by fifteen tableau of called bingo numbers 4, and the five-by-five bingo pattern tableau 5.

Each of the individual bingo cards 3 is filled with randomly selected twenty four bingo numbers 6 in the range of one to seventy five. The central solid black cell 7 of each bingo card 3 symbolically represents the free bingo cell of the respective card. The tableau of called bingo numbers 4 is arranged in fifteen horizontal rows and five vertical columns; the latter containing fifteen bingo numbers in increasing numerical order counting from top down. The bingo pattern tableau is intentionally left blank. the template 2 also carries a unique identification number 8.

The game board 1 carries a unique identification number 9 similarly to the template 2. Although the specific identification numbers 8 and 9 shown in FIG. 1 match, they may be different. The game board 1 accomodates the twelve-key membrane keyboard 10 embedded into the top face surface of the board. The keyboard 10 comprises ten numerical keys 11 zero through nine and two functional keys, namely, the enter key 12, marked "E", and the chance or caller key 13, marked "C". Next to the keyboard 10, the game board 1 accommodates the speaker 14 and power on-off switch 15. In addition, the game board 1 incorporates the telescopic radio antenna 16 and the RS232-C interface connector 17.

Figure 2:
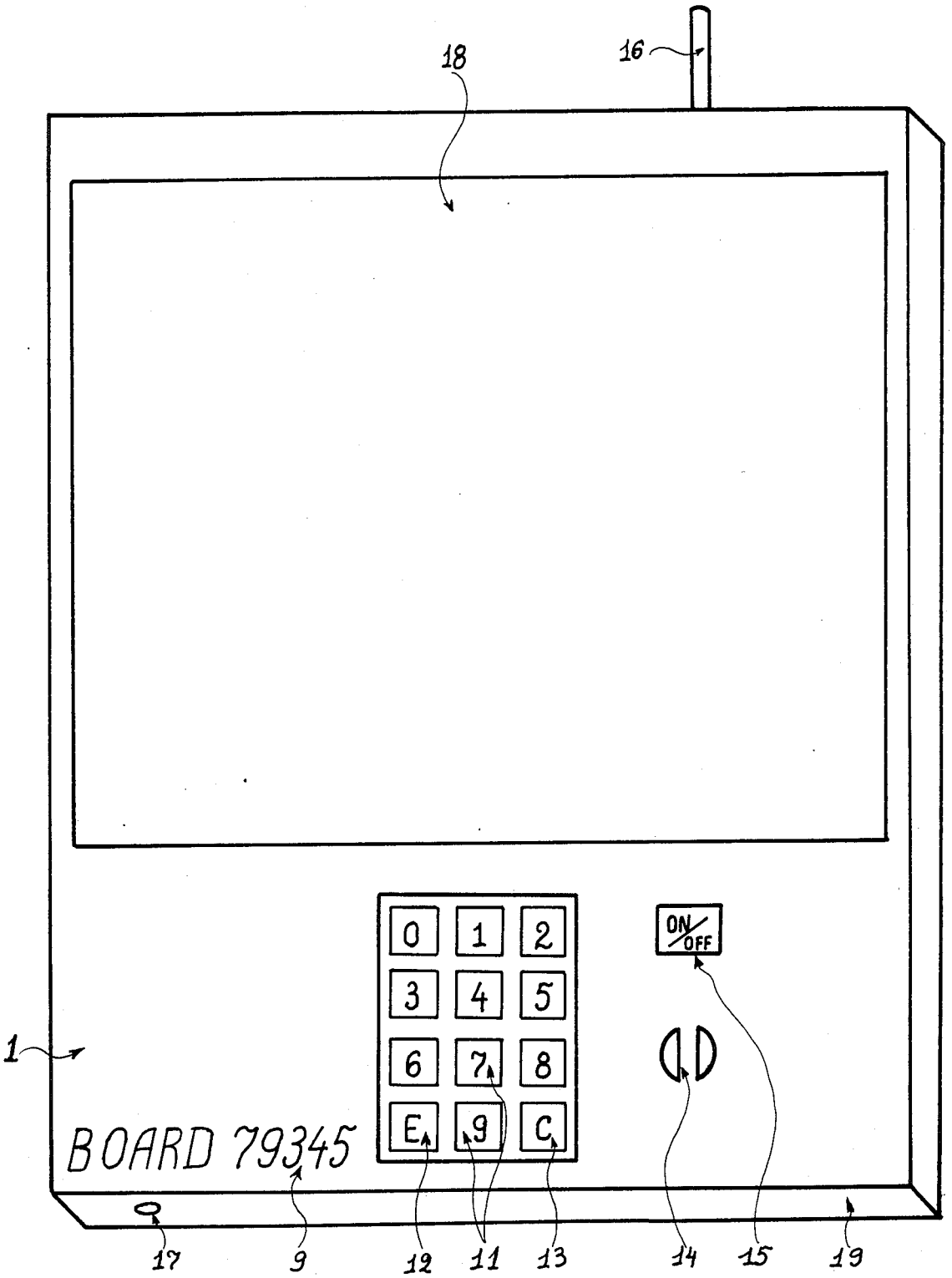
FIG. 2 is the perspective view of the uncovered game board without the template.
Figure 3:
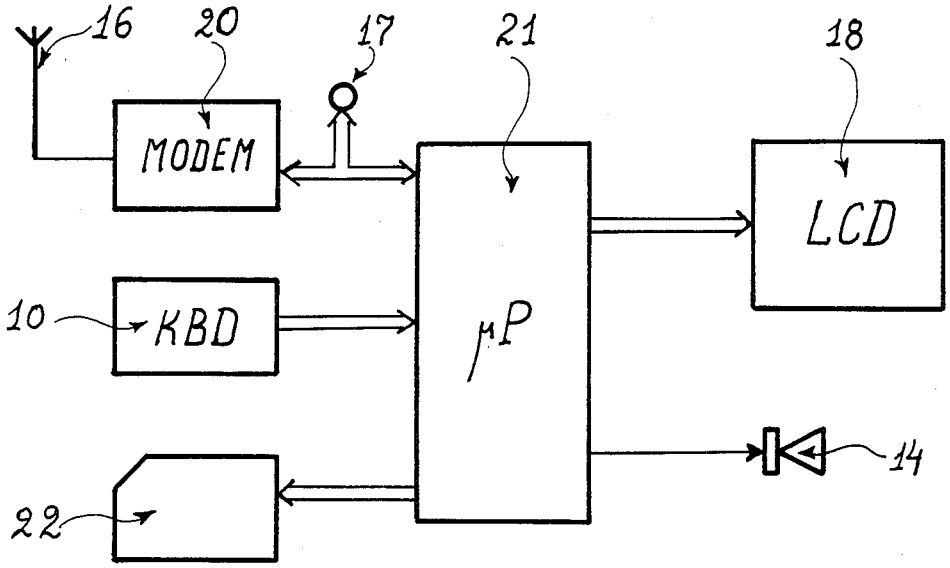
FIG. 3 is the block diagram of the electronic game board.

Immediately below the overlay template 2, the game board 1 incorporates the dot-matrix liquid crystall display (LCD) 18 visible through the template 2. With the template 2 removed, the uncovered game board 1 is presented in FIG. 2. The display 18 is shown blank in FIG. 2, as it appears following power-on reset. Electronic components of the game board 1 are embedded inside of its corpus 19. The primary elements of the electronics are the FSK modem 20 and the microprocessor 21. The FSK modem 20 is interfaced with the antenna 16 on one side and with the microprocessor 21 on the other side. The latter interface adheres to the RS232-C protocol and is accessible at the tap-off connector 17. The microprocessor 21 includes integrated input/output buffer/drivers for receiving commands and data from the keyboard 10 and for driving the display 18 and the speaker 14. An optional interface with a card reader 22 is shown in FIG. 3 as well. The board is powered up by a battery or a photovoltaic pannel, but neither is explicitly shown in FIG. 3. Similarly a read only memory (ROM), a random access memory (RAM), and a central processor unit (CPU) integrated into the microprocessor 21 are not explicitly presented in FIG. 3.

Figure 4:
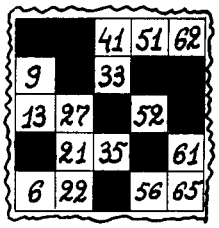
FIG. 4 is the partial view of the template exhibiting an individual bingo card.
Figure 5:
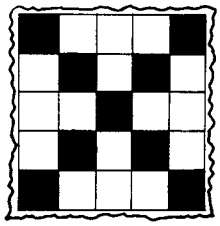
FIG. 5 is the partial view of the template exhibiting a bingo pattern.

All the operations of the game board 1 are controlled by the microprocessor 21. The primary function of the microprocessor 21 is controlling the display 18. Since the display 18 is of a dot-matrix nature, it is capable of displaying graphics and alphanumerical symbols. the repertoire of images presentable on the display 18 is restricted only by its resolution, i.e. the number of dots. When power is switched on, the microprocessor 21 blanks out the display 18. As the game progresses, the microprocessor drives certain areas of display 18 into the nontransparent state, i.e. darkens these areas. Since the template 2 is transparent and overlays the display 18, the nontransparent areas of the display 18 are clearly visible through the template 2. Consequently, darkening a display area immediately beneth a certain cell in the template 2 creates a visual image of marking, i.e. masking out, the respective cell. For example, a snap shot of the top left bingo card 3 in the template 2 and the underlying area of display 18 are presented in FIG. 4. for a hypothetical stage of a bingo game in which the bingo numbers "7", "10", "24", "25", "34", "53", "55", "64", and "70" have been called by the time of taking the snap shot. Similarly, the "X"-bingo pattern formed by darkening the diagonal areas of the display 18 underlying the bingo pattern tableau 5 is presented in FIG. 5.

Figure 6:
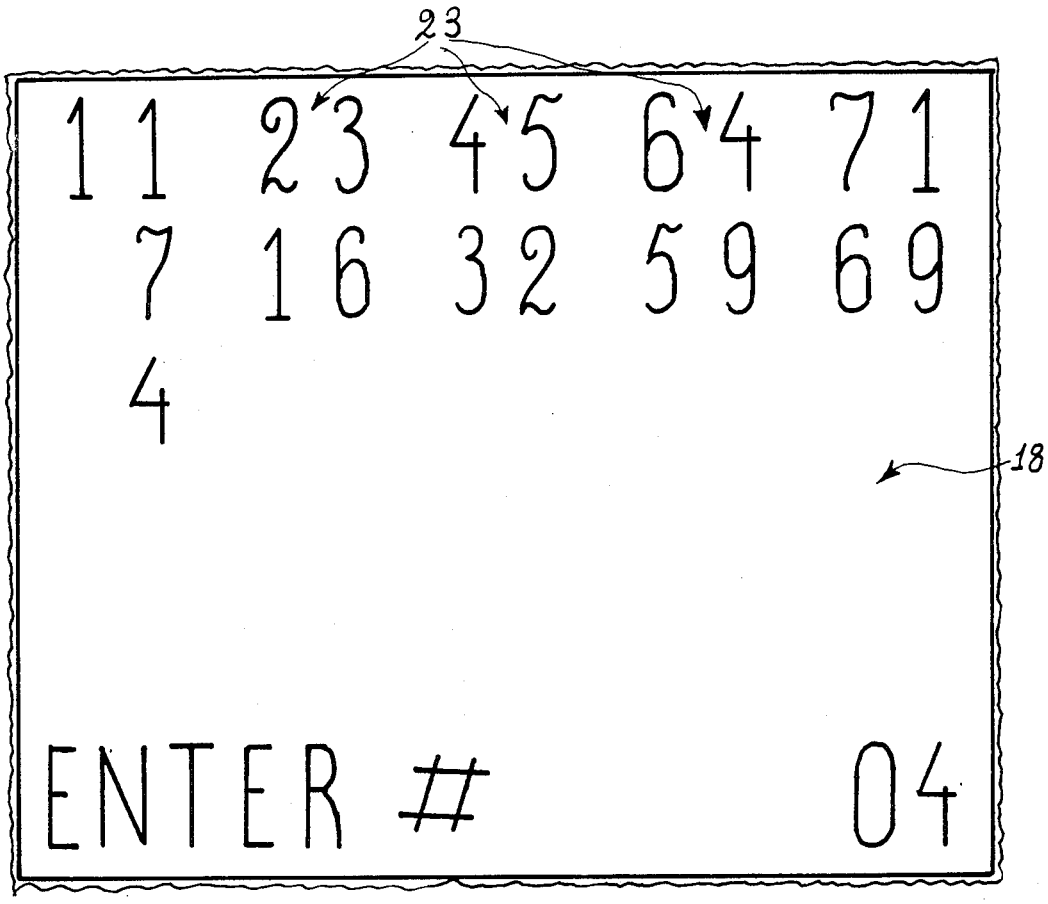
FIG. 6 is the partial view of the display exhibiting a do-it-yourself bingo card.
Figure 7:
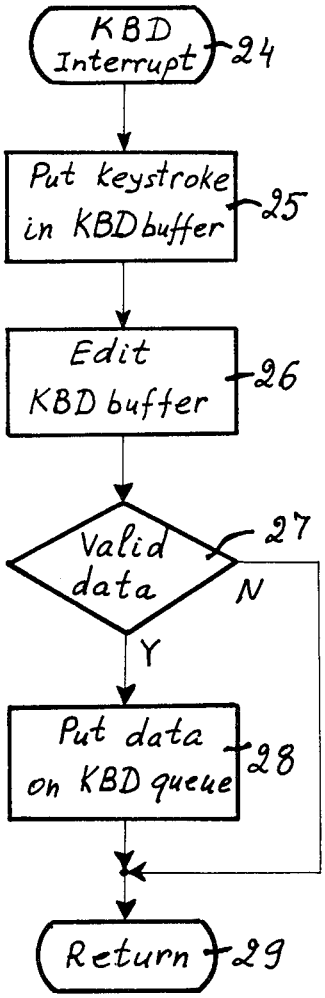
FIG. 7 is the flowchart of the keyboard interrupt routine.

An important advantage of using transparent template 2 is the low resolution requirements for the display 18. It is conceivable to utilize a high resolution dot-matrix LCD and show all the bingo numbers directly in the display. If so, ninety six dots are required to display a two-digit bingo number; whereas with the template 2, only one dot of a large size allows to mark the same bingo number resulting in a dramatic simplification of the game board. Yet, provided the overall number of dots in the display 18 is adequate, the display is useful for playing a do-it-yourself bingo wherein the player designs a bingo card by entering desired bingo numbers via the keyboard 10 and observing them in the display 18. An example of do-it-yourself bingo card image being made is shown in FIG. 6 with the cover template 2 removed completely. The individual bingo numbers 23 shown in FIG. 6 are of a much large size than those ones in the template 2, since the minimum resolution of the display 18 is dictated by the multiple-bingo-card template 2 rather than by the single-bingo-card do-it-yourself image.

The game board 1 can be utilized either by the game operator, e.g. caller, or by the individual player. Under normal circumstances, the operator employs the game board 1 for generation and broadcasting random bingo numbers, i.e. called bingo numbers; whereas the individual player employs the game board 1 for automatic monitoring of the broadcasted called bingo numbers and automatic verification of the matches between the called bingo numbers and the card bingo numbers 6 imprinted on the display 18.

The user interface with the game board 1 is very simple. All that the caller is required to do is to switch it on using the power on-off switch 15, enter a numerical identification number of the bingo pattern being played via the keyboard 10, terminate the number with the keystroke "E" 12, and then push the "C" button 13 causing generation, broadcasting, and displaying of a new random bingo number in the tableau 4 each time when the button 13 is pressed. Assuming that the board identification number 9 matches the template identification number 8, the player is not required to do anything but to power-up the board 1 by the switch 15. The game board 1 will then automatically receive the broadcasted bingo pattern and called bingo numbers, display them in the tableaus 5 and 4 respectively, and mark the matches between the bingo card numbers 6 and the called bingo numbers in each card 3. Finally, the board 1 will automatically announce the game completion via the speaker 14 if the bingo status is achieved in any of the cards 3 for the braodcasted bingo pattern displayed in the tableau 5.

The operation of the game board 1 controlled by the microprocessor 21 is illustrated by the flowcharts in FIGS. 7 through 10. In order to simplify explanation, we assume that only the caller activates the "C" button 13, e.g. the "C" button is deactivated in the player's board. In addition, we assume that the caller's board can only transmit; whereas the player's board can only receive radio signals.

The interface of the game board 1 with the environment is interrupt-driven. If the keyboard interrupt is unmasked and enabled then any keystroke causes the keyboard interrupt 24 to occur as presented in FIG. 7. In responce to the interrupt 22, the keystroke which caused the interrupt is placed in the keyboard input buffer in the step 25. The input buffer is edited in the step 26. If a valid, e.g. properly terminated by keystrokes "C" or "E", input string is discovered in step 27 then the corresponding command or data string is placed on the keyboard output queue in step 28 and the microprocessor returns from the interrupt in the step 29. Otherwise, the processor immediately returns from interrupt in the step 29.

Figure 8:
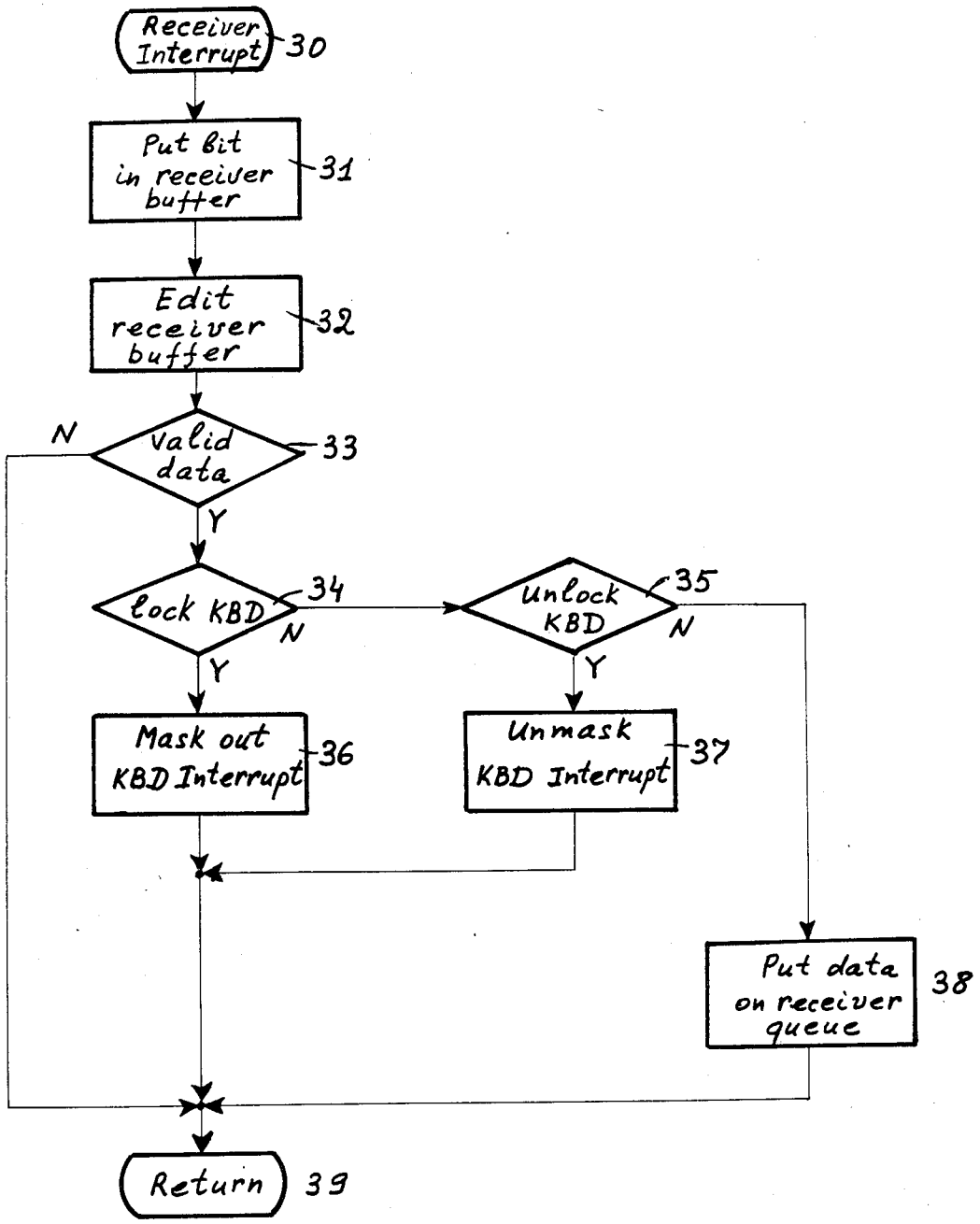
FIG. 8 is the flowchart of the receiver interrupt routine.

The receiver interrupt is unmasked and enabled upon initialization and stays unmasked and enabled thereafter. A command or data transmitted by the caller's game board is received by the antenna 16 of the player's game board, demodulated by the modem 20, and the resulting pulse string is relayed to the microprocessor 21 causing the receiver interrupt to occur in the step 30 as shown in FIG. 8. The received pulse string is placed in the receiver input buffer in the step 31 and edited in the step 32. Any valid command or data discovered in the step 33 is first checked in the consecutive steps 34 through 35 whether the keyboard lock or keyboard unlock command is received. The keyboard lock command results in masking out the keyboard interrupt in the step 36 thus preventing further local keyboard entries. The opposite command results in unmasking the keyboard interrupt in the step 37 thus reenabling local keyboard entries. Any other valid command or data is put on the receiver output queue in the step 38. The receiver interrupt processing always ends up in return from interrupt executed in the step 39.

Figure 9:
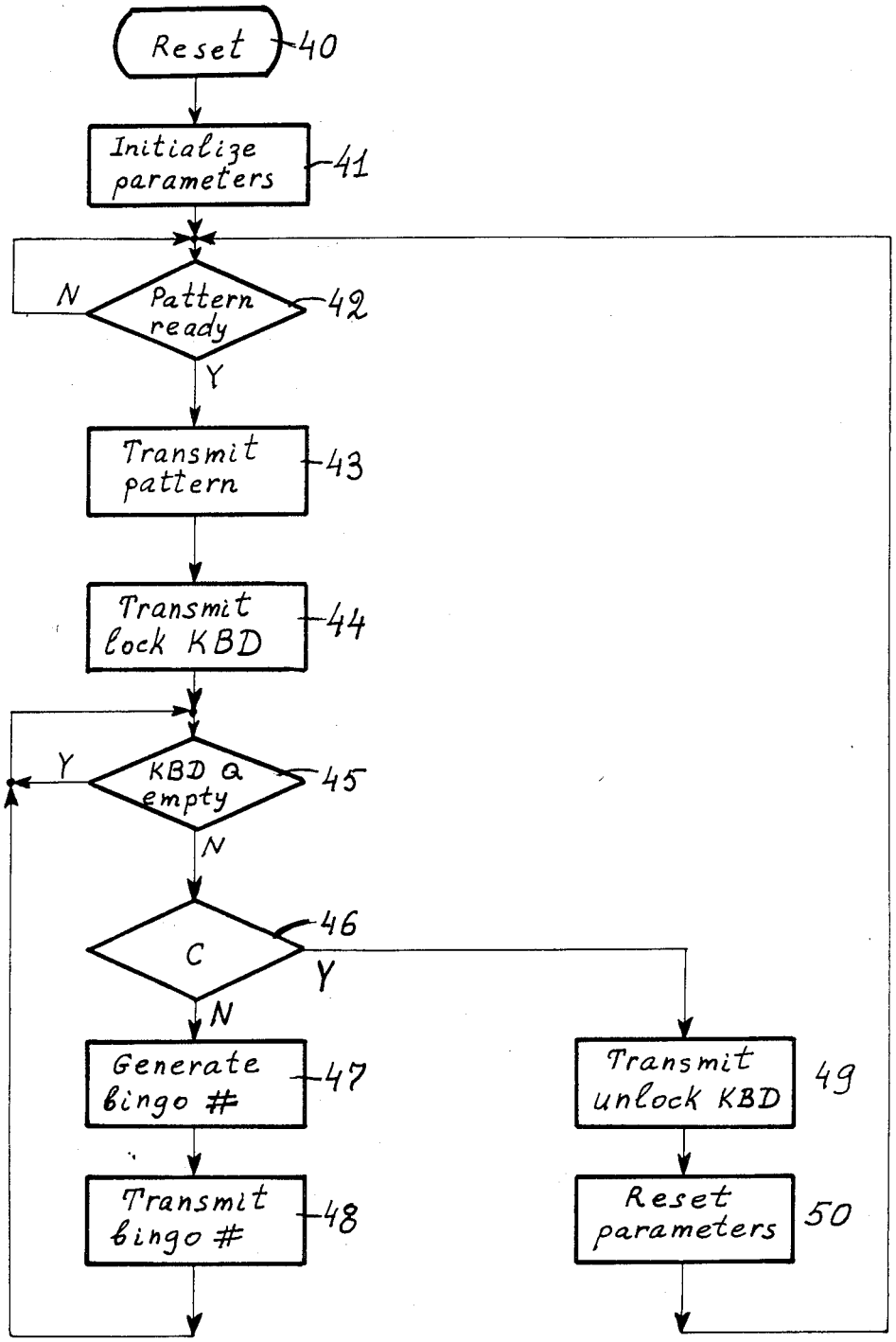
FIG. 9 is the flowchart of the master board main line.

The caller's board main line processing is presented in the flow chart in FIG. 9. Following the reset in the step 40, the microprocessor 21 initializes internal variables and parameters, such as flags, registers, counters, pointers, interrupts, etc. in the step 41. Subsequently, the microprocessor 21 polls the keyboard output queue in the step 42 until the bingo pattern for the next round of the game is dequeued. This bingo pattern is encoded in a pulse stream and output to the modem 20 in the step 43. The modem 20 broadcasts the pattern via the antenna 16 to all the players in its turn. Next, the microprocessor transmits the KEYBOARD LOCK command in the step 44 causing the disabling of the player's keyboard. At this point, the microprocessor 21 starts to poll the keyboard output queue in the step 45 looking for a command to execute. If the "C" command is found in the step 46, then a new random bingo number in the range one to seventy five is generated in the step 47 using one of the standard rountines for generation of nonrepetitive random numbers. This random bingo number is then output to the modem 20 in the step 48. The modem 20 broadcasts the number via the antenna 16. By definition, the transmitted bingo number becomes the called bingo number for all the players. The microprocessor 21 then returns to the keyboard output polling process in the step 45.

If the outcome of the test in step 46 is negative, i.e. other than "C" command is found on the queue, then the microprocessor 21 transmits the KEYBOARD UNLOCK command in the step 49 and, after resetting parameters in the step 50, returns to polling the keyboard output queue in search of the new bingo pattern.

Figure 10:
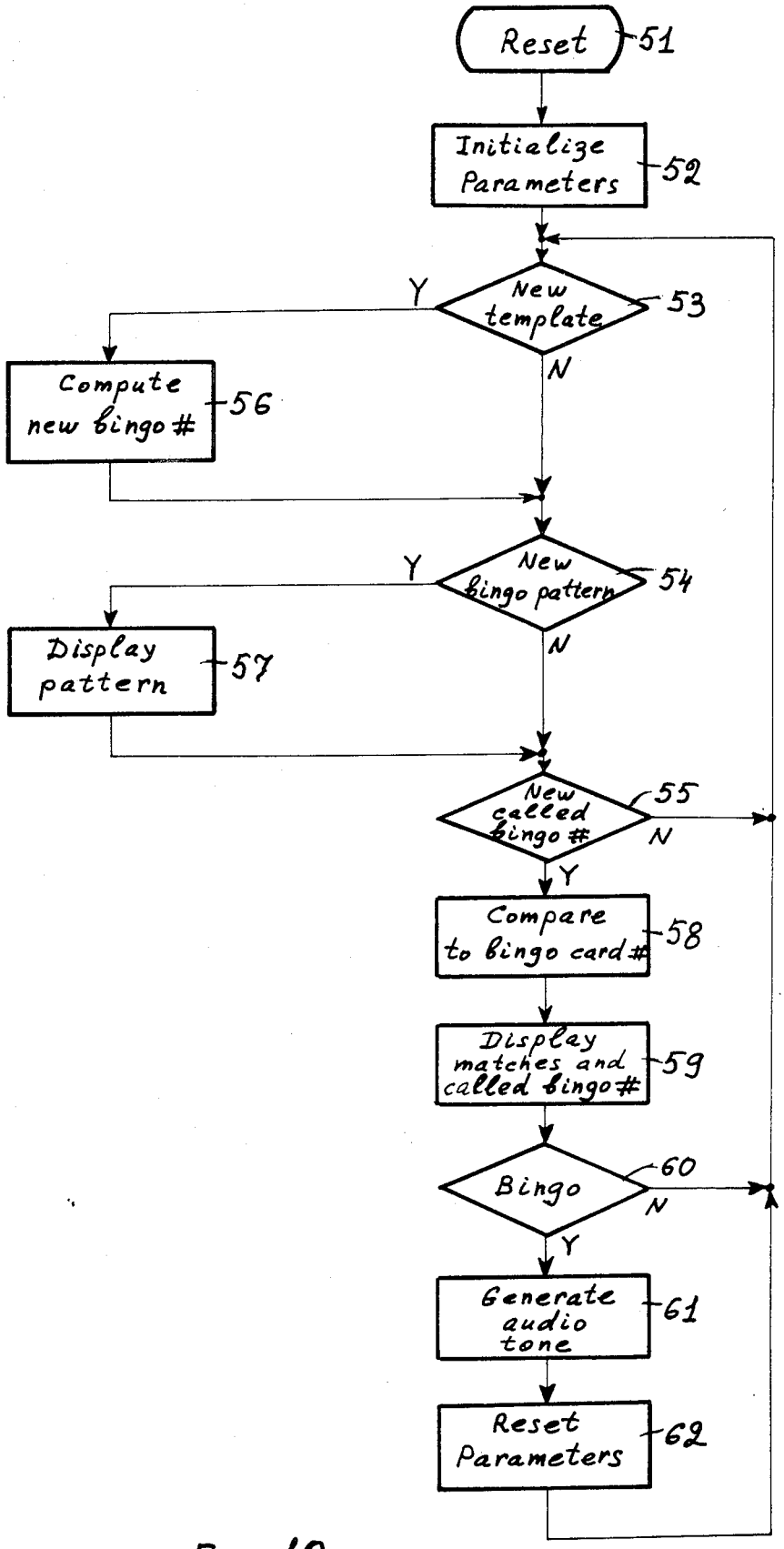
FIG. 10 is the flowchart of the player's board main line.

In the player's game board, the main line processing starts with the reset in the step 51 in FIG. 10 followed by the initialization of parameters in the step 52. The process of initialization in the step 52 includes setting up the default bingo card numbers 6 corresponding to the game board's identification number 9, e.g. the default bingo card numbers are copied from ROM into a table of current bingo card numbers located in RAM. Upon completion of the initialization process, the microprocessor 21 starts polling of the keyboard output queue and the receiver output queue in the steps 53 through 55 until either a new template identification number, or a new bingo pattern, or a new called bingo number is found. If a new template identification number is found in the step 53, e.g. the player replaced the default template with a new one and entered the identification number of this template via the keyboard 10, then the microprocessor 21 computes the new bingo card numbers in the step 56 and puts them in the table of current bingo card numbers in RAM. For example, the microprocessor 21 may use a part of the template identification number 8 as the entry pointer into a ROM-based circular table of random numbers modulo fifteen and utilize the rest of the template identification number 8 as an offset for picking up the next random number out of this table. Or the microprocessor 21 may use the template identification number 8 as a seed number for the pseudo-random number generation routine. Obviously, the very same algorithm must be used for selection of the bingo numbers 6 imprinted in the template 2.

If a new bingo pattern is found in the step 54, then the encoded pattern identification number is stored in RAM and the respective image is displayed in the tableau 5 in the step 57.

Finally, if a new called bingo number is received in the step 55, then the number is displayed in the tableau 4 and compared with all the bingo numbers in the current table of bingo card numbers in the step 58. The matches, if any, are identified and marked on the display 18 in the step 59. Subsequently, in the step 60, the microprocessor 21 checks whether the successful state of bingo is achieved in at least one of the individual bingo cards in the multiple bingo card template 2 by comparing the resulting pattern of matches with the current bingo pattern being played. If the bingo state is discovered, the microprocessor 21 causes the speaker 14 to generate an audible signal in the step 61 and resets the necessary parameters in the step 62 as a preparation for the next round of the game. Otherwise, the microprocessor 21 resumes polling the output queues of the keyboard and the receiver.

While a specific embodiment of the invention has been shown and described in detail to illustrate the application of the invention principles, it is understood that the invention may be embodied otherwise without departing from such principles.

The game board 1 can be easily adapted for playing a do-it-yourself bingo, wherein the cover template 2 is removed and the player designs arbitrary bingo cards by entering desirable bingo numbers via the keyboard 10. Although FIG. 6 presents only one do-it-yourself bingo card image being made, a number of such cards can be stored in RAM and played concurrently. An important feature of operations of the game board 1 in the do-it-yourself mode is locking the keyboard 10 by remote command to prevent the player from altering the card contents after the game starts and unlocking the keyboard 10 by caller's remote command to let the players the opportunity to update the do-it-yourself bingo cards. The process of locking and unlocking the keyboard in the do-it-yourself mode is identical with the process of locking and unlocking the keyboard in a regular bingo game described above.

The basic game board design presents an opportunity to play a variety of games akin to bingo. In particular, a keno-type game can be easily implemented. It is sufficient just to replace the template 2 with another one, such as presented in FIG. 11. The template in FIG. 11 is subdivided into five identical hundred-cell tableaus 63 filled with numbers one to hundred in increasing order. The top four areas 63 are available for selection of bets by the player, whereas the bottom tabloid is reserved for automatic marking of the called keno numbers which are broadcasted by the caller's game board. The user enters his bets via the keyboard 10, and the microprocessor 21 marks respective matches utilizing the display 18. Again, the player's keyboard is locked and unlocked by the caller remotely.

The specific design of the keyboard can be easily modified to accomodate requirements of the game. For example, playing the do-it-yourself bingo and keno games is facilitated by introduction of direction keys, such as "up-key", "down-key", "left-key", "and right-key". Special function keys can be added. In particular, the verify-key scanning the tableau of called bingo numbers 4 with concurrent marking of the matching bingo numbers in the cards 6 is quite beneficial.

Figure 12:
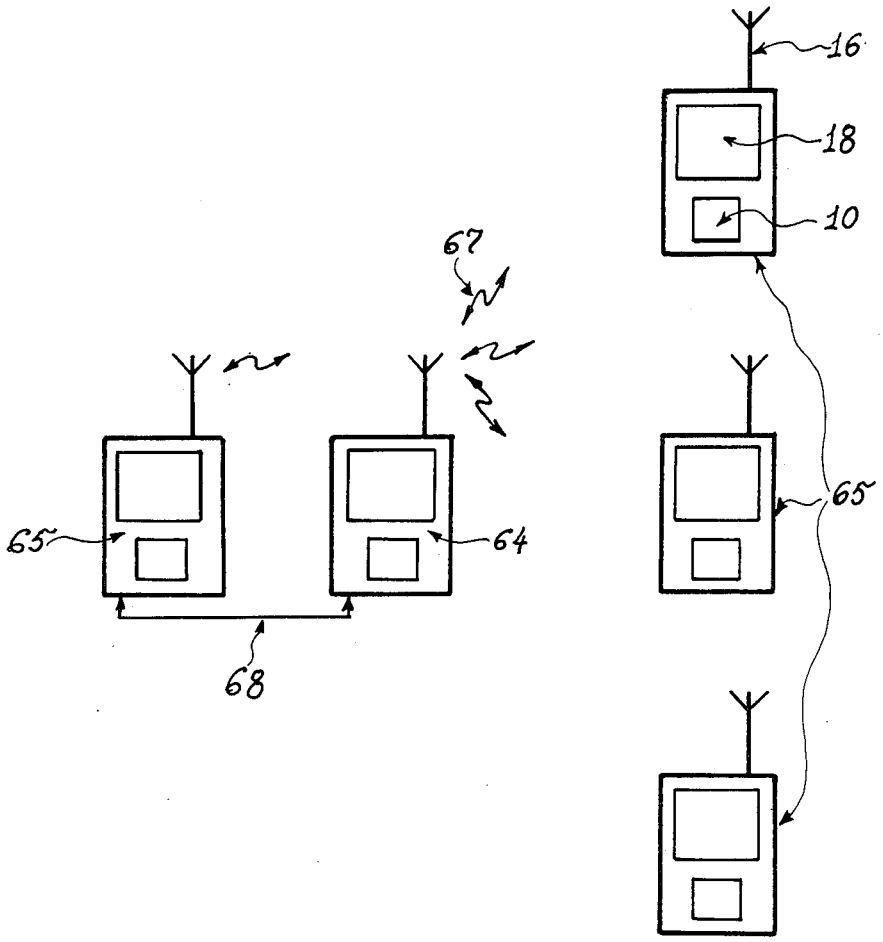
FIG. 12 is the block diagram multi-game board communication network.

Although only two game boards are sufficient to play a game, under normal circumstances, one caller's board and a large number of players' boards are involved in the game. The multi-board game is illustrated in the block-diagram in FIG. 12 wherein the caller's board is marked 64, and players' boards are denoted 65. Each of the boards involved in the game is provided with an antenna 16, keyboard 10, and display 18. Curved arrows 67 in FIG. 12 symbolize a two-way communication between game boards 64 and 65.

A two-way communication between master board and player's game board can significantly improve reliability of the game. For example, the player's game board can automatically notify the caller's game board about successful completion of the game. The two-way communication can be used for uploading the master board and downloading the player's board with the game card contents. In particular, the master game board equipped with a disk and a printer can store the contents of player-created do-it-yourself bingo cards for future use and even print templates for the player.

Moreover, players' boards can communicate laterally, e.g. for cooperation in the process of "war" type game. In general, the game boards can communicate with each other remotedly, e.g. via local area network. The specific communication channel is not restricted to radio only. Infrared or fiber communication means may be beneficial in a number of applications. Virtually any remote communication means or a combination of such means is applicable. For example, the RS232 interface 68 can be used for uploading the master board and downloading the player's board with a game card related information before the game begins, whereas the radio channel can be used thereafter for broadcasting and receiving called bingo numbers.

FIG. 3 shows an optional card reader 22. The card reader can be used for reading information directly from the template 2 having perforations along its edge. The perforations may carry the template identification number 8 in encoded form. Instead of entering the identification number manually, the player then could just insert the template into the receptacle of the card reader 22, and the rest of work would be done by the game board automatically. The card reader receptacle could also serve as a card retainer.

Although the overlay template 2 is removable and replacable, it can be attached to the game board 1 in many ways, e.g. it can be secured to the board 1 on hinges allowing the opportunity of flipping over the template from the position on the top of the board to the position at the bottom of the game board. Under such an arrangement, the game board has a default template with the identification number identical to the board's identification number, and the player is relieved from the need to intervene in the operation of the board as long as the default template is used. By flipping the default template over, an opportunity to play any other template or do-it-yourself game is readily provided.

While the invention has been described in some detail above, it is to be understood that this detailed description is by way of example only, and the protection granted is to be limited only within the spirit of the invention and the scope of the following claims.

What is claimed is:

1. In combination, a predetermined set of game cards and a game network for playing a game utilizing said predetermined set of game cards;

said game network comprising:

at least one master game board incorporating a master data input means, a master data processing means responsive to said master data input means, and a master data output means responsive to said master data processing means, at least one player's game board incorporating a player's input means responsive to said master data output means, a player's data processing means responsive to said master data output means, and a player's data output means responsive to said player's data processing means;

said master game board transmitting via said master data output means predetermined data relevant to said game, and random data at least partially matching said predetermined set of game cards;

said player's game board comprising means for receiving said predetermined data and said random data via said player's data input means, means for storing an informational content of at least one game card out of said predetermined set in said player's data processing means, comparison means for comparing said predetermined data and said random data on one hand, and said informational content on the other hand, and means for signalling the current status of said card game via said player's data output means as determined by said comparison.

2. The combination of claim 1, wherein said player's data input means includes a local data entry means.

3. The combination of claim 2, wherein said player's game board includes means to compute at least a portion of said informational content by processing an alphanumerical identification number of said game card in accordance with a predetermined rule; and said alphanumerical identification number being entered via said player's local data entry means.

4. The combination of claim 2, wherein said player's local data entry means includes lock means that is remotely locked and unlocked by a predetermined command included in said predetermined data.

5. The combination of claim 1, wherein said player's data output means includes a data display means and a sound generating means.

6. The combination of claim 1, wherein at least one of said game cards out of said set is a transparent template bearing visual game symbols and overlaying said player's display.

7. The combination of claim 1, wherein said player's game board includes means to transmit said informational content and said current status back to said master game board via said player's data output means.

* * * * *

US004624462B1

REEXAMINATION CERTIFICATE (3023rd)

United States Patent [19] [11] B1 4,624,462

Itkis [45] Certificate Issued * Oct. 15, 1996

[54] ELECTRONIC CARD AND BOARD GAME

[75] Inventor: Yuri Itkis, Arcadia, Calif.

[73] Assignee: Fortunet Inc., Las Vegas, Nev.

Reexamination Request:
No. 90/003,992, Oct. 5, 1995

Reexamination Certificate for:

| | |
|---|---|
| Patent No.: | **4,624,462** |
| Issued: | **Nov. 25, 1986** |
| Appl. No.: | **611,951** |
| Filed: | **May 18, 1984** |

[ * ] Notice: The portion of the term of this patent subsequent to Jun. 19, 2001, has been disclaimed.

Related U.S. Application Data

[63] Continuation-in-part of Ser. No. 301,118, Aug. 11, 1981, Pat. No. 4,455,025.

[51] Int. Cl.[6] ..... A63F 3/06

[52] U.S. Cl. ..... 273/237; 273/269

[58] Field of Search ..... 273/237, 238, 273/239, 269, 286

[56] References Cited

U.S. PATENT DOCUMENTS

| | | |
|---|---|---|
| 3,671,041 | 6/1972 | Taylor et al. . |
| 4,254,404 | 3/1981 | White . |
| 4,339,798 | 7/1982 | Hedges et al. . |
| 4,365,810 | 12/1982 | Richardson . |
| 4,373,726 | 2/1983 | Churchill et al. . |
| 4,378,940 | 4/1983 | Gluz et al. . |

OTHER PUBLICATIONS

PLATO Curricular Materials, Feb. 1979.

PLATO Computer Bingo System Materials (1976–1980).

*Primary Examiner*—Jessica J. Harrison

[57] ABSTRACT

An electronic card and board game for playing bingo, keno, and the like games, wherein the master game board being operated by the caller generates and transmits random bingo numbers and game patterns, and the player's game board receives and processes the bingo numbers and game patterns, and the player's game board receives and processes the received information in conjunction with locally originated data determining the contents of a multiple bingo card. The multiple bingo card is implemented as a replaceable, removable transparent template bearing imprinted bingo numbers. In working position, the card overlays a dot-matrix display incorporated in the player's game board. The display is controlled by a microprocessor. The microprocessor activates the display dots located beneath the bingo numbers matching those transmitted by the master board via a radio channel. The microprocessor computes bingo numbers on the card using the identification number of the card in accordance with a predefined algorithm.

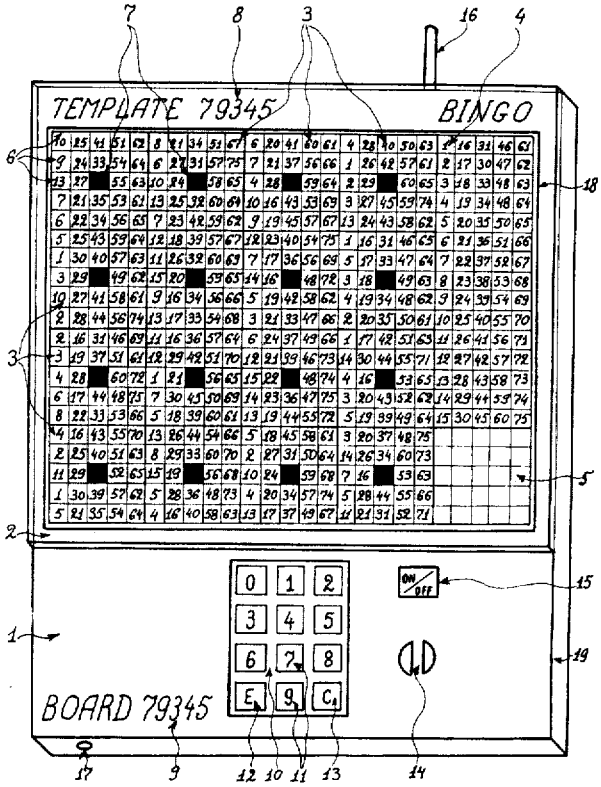

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1, 2, 3, 4, 5, 6 and 7 is confirmed.

* * * * *

US004624462B2

REEXAMINATION CERTIFICATE (4090th)

United States Patent [19] [11] B2 4,624,462

Itkis [45] Certificate Issued *May 23, 2000

[54] ELECTRONIC CARD AND BOARD GAME

[75] Inventor: Yuri Itkis, Arcadia, Calif.

[73] Assignee: Fortunet Inc., Las Vegas, Nev.

Reexamination Request:
No. 90/005,230, Jan. 25, 1999

Reexamination Certificate for:

| | |
|---|---|
| Patent No.: | **4,624,462** |
| Issued: | **Nov. 25, 1986** |
| Appl. No.: | **06/611,951** |
| Filed: | **May 18, 1984** |

Reexamination Certificate B1 4,624,462 issued Oct. 15, 1996

[ * ] Notice: This patent is subject to a terminal disclaimer.

Related U.S. Application Data

[63] Continuation-in-part of application No. 06/301,118, Aug. 11, 1981, Pat. No. 4,455,025.

[51] Int. Cl.[7] ..... A63F 3/06

[52] U.S. Cl. ..... 273/237; 273/269

[58] Field of Search ..... 463/19, 18, 17, 463/16, 42, 41, 40; 273/274, 269, 237; 434/323

[56] References Cited

U.S. PATENT DOCUMENTS

| | | | |
|---|---|---|---|
| 2,760,619 | 8/1956 | Peak | 194/16 |
| 3,405,457 | 10/1968 | Bitzer | 434/323 |
| 3,671,041 | 6/1972 | Taylor et al. | 273/135 A |
| 4,312,511 | 1/1982 | Jullien | 273/237 |
| 4,339,798 | 7/1982 | Hedges et al. | 364/412 |
| 4,373,726 | 2/1983 | Churchill et al. | 273/138 |
| 4,378,940 | 4/1983 | Gluz et al. | 273/237 |

OTHER PUBLICATIONS

PLATO Courseware Agreement, Mar. 1976.

PLATO Course Catalog, © 1980 by Control Data Corp.

*Primary Examiner*—Mark A. Sager

[57] ABSTRACT

An electronic card and board game for playing bingo, keno, and the like games, wherein the master game board being operated by the caller generates and transmits random bingo numbers and game patterns, and the player's game board receives and processes the bingo numbers and game patterns, and the player's game board receives and processes the received information in conjunction with locally originated data determining the contents of a multiple bingo card. The multiple bingo card is implemented as a replaceable, removable transparent template bearing imprinted bingo numbers. In working position, the card overlays a dot-matrix display incorporated in the players's game board. The display is controlled by a microprocessor. The microprocessor activates the display dots located beneath the bingo numbers matching those transmitted by the master board via a radio channel. The microprocessor computes bingo numbers on the card using the identification number of the card in accordance with a predefined algorithm.

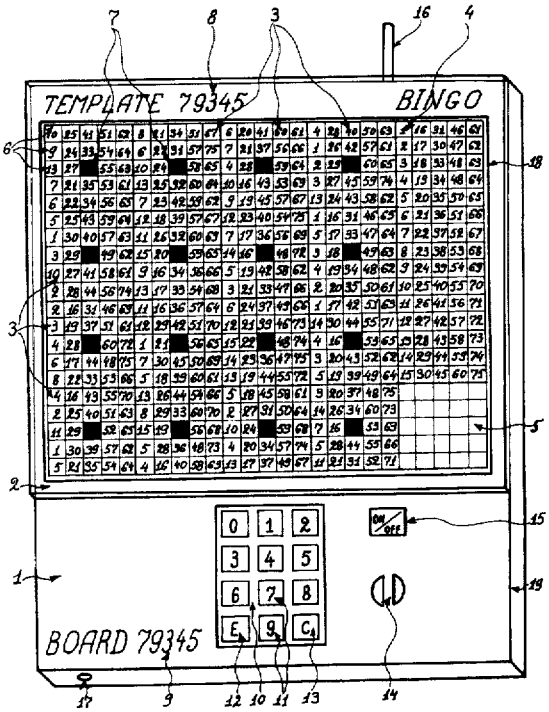

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1 and 2–7 is confirmed.

New claims 8 and 9–10 are added and determined to be patentable.

*8. The combination of claim 1, wherein said predetermined data includes bingo pattern data.*

*9. Combination of claim 1, wherein said master game board transmits said informational content via said master data output means and said player's game board receives said informational content via said player's data input means.*

*10. Combination of claim 9, wherein said informational content includes an identification number of said game card.*

* * * * *